US005575164A

United States Patent [19]

Ohsawa

[11] Patent Number: 5,575,164

[45] Date of Patent: Nov. 19, 1996

[54] COMBINATION LOCK

[75] Inventor: Tsuguyoshi Ohsawa, Sagamihara, Japan

[73] Assignee: K I International Co., Ltd., Tokyo, Japan

[21] Appl. No.: 511,225

[22] Filed: Aug. 4, 1995

[51] Int. Cl.[6] ..... E05B 37/08

[52] U.S. Cl. ..... 70/303 A; 70/302; 70/309

[58] Field of Search ..... 70/301, 302, 303 R, 70/303 A, 309, 190

[56] References Cited

U.S. PATENT DOCUMENTS

| | | | |
|---|---|---|---|
| 3,196,643 | 7/1965 | Moss | 70/309 |
| 4,106,316 | 8/1978 | Tippin | 70/303 A |
| 4,694,670 | 9/1987 | Jang | 70/303 A |

*Primary Examiner*—Lloyd A. Gall

*Assistant Examiner*—Robert G. Santos

*Attorney, Agent, or Firm*—Wenderoth, Lind & Ponack

[57] ABSTRACT

A combination lock includes a dial shaft adapted to be rotated with a user's hand, a fore lock plate, at least one intermediate lock plate and a rear lock plate arranged in parallel with each other, and a driving plate integrally fitted to a rear end of the dial shaft. A plurality of unlocking cutouts are formed in the outer peripheries of the driving plate and all the lock plates so as to allow a lock pawl to be received in the unlocking cutouts when the latter are located in alignment with each other. A driving gear having a large diameter is formed in the driving plate, and a follower gear having a small diameter is formed on the fore lock plate. Both the gears mesh with each other at a gear ratio via an idler gear so as to allow the gears to be rotated in the opposite directions. The gear ratio is determined such that all the lock plates are followably rotated as a dial knob is turned with a user's hand. Usually, the number of lock plates is four, the gear ratio of the driving gear to the follower gear is set to 3:1.

3 Claims, 11 Drawing Sheets

COMBINATION LOCK

BACKGROUND OF THE INVENTION

1. Field of the Invention

The present invention relates generally to a combination lock for storably holding various items. More particularly, the present invention relates to a combination lock which assures that unlocking can easily be achieved with substantial reduction of rotation of dial plates.

2. Description of the Prior Art

To facilitate understanding of the present invention, a conventional combination lock will be described below with reference to FIG. 26 to FIG. 32.

As shown in FIG. 26, a dial knob 1 includes a dial shaft 2 to a rear end of which a rear end lock plate 3*a* is fastened by tightening a lock nut 4 in such a manner that it is rotated together with the dial knob 1. First and second intermediate lock plates 3*b* and 3*c* and a fore lock plate 3*d* are rotatably fitted onto the dial shaft 2. Reference numeral 5 denotes spacers which are interposed between adjacent lock plates among the lock plates 3*a*, 3*b*, 3*c* and 3*d*, and reference numeral 6 denotes a compression spring. Unlocking cutout 7*a*, 7*b*, 7*c* and 7*d* are formed on the outer peripheries of the lock plates 3*a*, 3*b*, 3*c* and 3*d* for receiving lock pawl A when they are located in alignment with the lock pawl A so as to allow the combination lock to be unlocked. In addition, engagement projections 8 to 13 are formed on side surfaces of the lock plates in the following manner.

An engagement projection 8 is formed on the fore side surface of the lock plate 3*a*, an engagement projection 9 is formed on the rear side surface of the lock plate 3*d*, two engagement projections 10 and 11 are formed on the opposite side surfaces of the lock plate 3*b* and two engagement projections 12 an 13 are formed on the opposite side surfaces of the lock plate 3*c*. It is obvious that each of the projections 8 to 13 is formed at a predetermined position with each of the unlocking cutouts 7*a* to 7*d* as a reference position for unlocking. Reference numeral 14 denotes a plane plate fixed to an opening/closing door of a safe, and reference numerals 15 and 16 denote first and second shaft bearings of the dial shaft 2.

FIG. 27 is a perspective view which shows the lock plates 3*a* to 3*d* in the disassembled state. When unlocking is effected, first, the rear lock plate 3*a* is rotated in the clockwise direction by an angle of 360 degrees so that engagement projection 8 is engaged with a rear engagement projection 11 of the first intermediate lock plate 3*b*.

Next, as shown in FIG. 28, the lock plate 3*a* is rotated in the same direction by an angle of 360 degrees so that the fore engagement projection 10 of the first intermediate lock plate 3*c* is engaged with rear engagement projection 13 of the second intermediate lock plate 3*c*.

Subsequently, as shown in FIG. 29, the lock plate 3*a* is rotated in the same direction by an angle of 360 degrees so that the fore engagement projection 12 of the second intermediate lock plate 3*c* is engaged with rear engagement projection 9 of the lock plate 3*d*. Moreover, the lock plate 3*a* is rotated by an angle less than 360 degrees until a predetermined memory value (e.g., 33) is assumed. Thereafter, the unlocking cutout 7*d* of the lock plate 3*d* is kept immovable at a predetermined position where it is oriented in the upward direction.

In detail, when the rear lock plate 3*a* is rotated by the dial knob 1 three times, the first intermediate lock plate 3*b* is rotated two times and the second intermediate lock plate 3*c* is rotated by one revolution so that the fore lock plate 3*d* starts to be rotated. In addition, by rotating the rear lock plate 3*a* by a predetermined angle less than 360 degrees to assume a predetermined memory numeral, the unlocking cutout 7*d* of the fore lock plate 3*d* can be held at a predetermined position.

Next, as shown in FIG. 30, the rear lock plate 3*a* is rotated in the counterclockwise direction by an angle of 360 degrees (one revolution) so that the engagement projection 8 is engaged with rear engagement projection 11 of the first intermediate lock plate 3*b*. Subsequently, the rear lock plate 3*a* is rotated in the same direction by an angle of 360 degrees so that the fore engagement projection 10 of the first intermediate lock plate 3*b* is engaged with rear engagement projection 13 of the second intermediate lock plate 3*c*. Thereafter, the second intermediate lock plate 3*c* is rotated by a predetermined angle less than 360 degrees corresponding to a predetermined memory numeral (e.g., 97) so that the unlocking cutout 7*c* is located in alignment with the unlocking cutout 7*d* of the rear lock plate 3*d* which has been kept immovable.

Next, as shown in FIG. 31, the lock plate 3*a* is rotated in the clockwise direction by an angle of 360 degrees so that the engagement projection 8 is engaged with rear engagement projection 11 of the first intermediate lock plate 3*b*. Additionally, the first intermediate lock plate 3*b* is rotated by a predetermined angle less than 360 degrees until a predetermined memory numeral (e.g., 64) is assumed so that the unlocking cutout 7*b* is located in alignment with those of the second intermediate lock plate 3*c* and the rear lock plate 3*d* which have been kept immovable.

Finally, as shown in FIG. 32, the lock plate 3*a* is rotated in the counterclockwise direction by a predetermined angle less than 360 degrees until a predetermined numeral (e.g., 84) is assumed so that the unlocking cutout 7*a* is located in alignment with those of the first and second intermediate lock plates 3*b* and 3*c* and the rear lock plate 3*d* which have been kept immovable. Thus, lock pawl A is received in the unlocking cutouts 7*a* to 7*b* of the lock plates 3*a* to 3*d*, whereby the combination lock is brought to an unlocked state.

As is apparent from the above-described procedure of unlocking, a conventional combination lock is typically unlocked by rotating the knob from a reference numeral (e.g. zero) in the normal direction by three revolutions, next rotating the knob in the reverse direction to assume a predetermined memory numeral by two revolutions, further rotating the knob in the normal direction to assume to a predetermined memory numeral, finally rotating the knob in the reverse direction to reach a predetermined memory numeral.

The above procedure of unlocking is only to applicable to a combination lock comprising four lock plates, but things are same with a combination lock including three or five lock plates. For example, in the case of a combination lock including three locking plates, in accordance with the operation principle, first the dial knob is rotated from a reference numeral in the normal direction by two revolutions, next the dial knob is rotated in the reverse direction by one revolution plus a fraction corresponding to a predetermined memory numeral. Similarly, in the case of a combination lock including five locking plates, first the dial knob is rotated in the normal direction by four revolutions, next the dial knob is rotated in the reverse direction by three revolutions plus a fraction corresponding to a predetermined memory numeral, further the dial knob is rotated again in the normal direction by two revolutions plus a fraction corresponding a predetermined memory numeral, subsequently, the dial knob is rotated in the reverse direction by one revolution plus a fraction corresponding to a predetermined memory numeral. Finally, the dial knob is rotated in the normal direction to the position corresponding a predetermined memory numeral.

At any rate, with respect to the conventional combination lock, the number of revolutions of the dial knob and a plurality of memory values must be exactly memorized. For this reason, it is complicated for an unskilled user to unlock the conventional combination lock in spite of excellent locking ability thereof.

Accordingly, the conventional combination lock is not widely put into practical use.

SUMMARY OF THE INVENTION

The present invention has been made in consideration of the aforementioned background.

An object of the present invention is to provide a combination lock that can be unlocked simply.

Another object of the present invention is to provide such a combination lock that can be unlocked in a short time.

According to the present invention, there is provided a combination lock which includes a dial shaft adapted to be rotated with a user's hand, a fore lock plate, at least one intermediate lock plate and a rear lock plate arranged in parallel with each other so as to allow them to be followably rotated via a plurality of engagement projections projected from opposite side surfaces of the lock plates, and a driving plate integrally fitted to a rear end of the dial shaft. A plurality of unlocking cutouts are formed in the outer peripheries of the driving plate and the lock plates so as to allow a lock pawl to be received in the unlocking cutouts when the latter are located in alignment with each other. A driving gear having a large diameter is formed in the driving plate, and a follower gear having a small diameter is formed on the rear lock plate located adjacent to the driving plate. The driving gear and the follower gear mesh with each other at a gear ratio via an idle gear so as to allow the driving and follower gears to be rotated in opposite directions, the gear ratio being determined such that all the lock plates are followably rotated as the dial knob is turned with a user's hand.

It is preferable that the number of lock plates if four, and the gear ratio of the driving gear to the follower gear is set to 3:1.

The follower gear is formed around the outer periphery of a hub portion of the rear lock plate. The driving plate is formed in a silk hat-like contour. The driving gear is formed around the inner periphery of the silk hat-like contour, and the idle gear is interposed between the driving gear and the follower gear facing to each other.

Other objects, features and advantages of the present invention will be apparent from the following description, in conjunction with the accompanying drawings.

DESCRIPTION OF THE PREFERRED EMBODIMENT

The present invention will be described in detail hereinafter with reference to the accompanying drawings which illustrates a preferred embodiment thereof.

Figure 1:
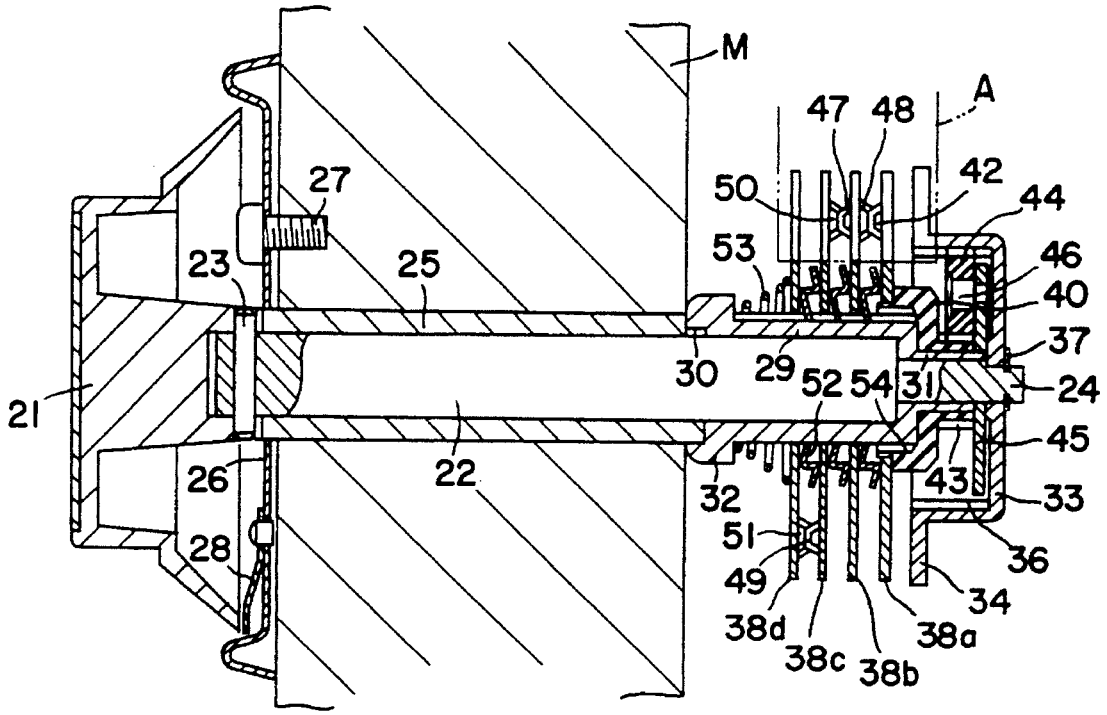
FIG. 1 is a vertical sectional view of a combination lock constructed in accordance with an embodiment of the present invention.

FIG. 1 is a vertical sectional view showing a combination lock for a safe composed of lock plates assembled for convenience of comparison with the conventional combination lock. Reference numeral 21 denotes a dial knob, and reference numeral 22 denotes a dial shaft which is made integral with the knob 21 by a knock pin 23. A rear end part of the dial shaft 22 is machined to form a stepped part having a small diameter.

Reference numeral 25 denotes a first bearing sleeve for supporting the fore part of the dial shaft 22. The first bearing sleeve 25 extends through an opening/closing door M for a safe (not shown), and a plane plate 26 integrated with the first bearing sleeve 25 is fixed to the front surface of the opening/closing door by tightening screws 27. Reference numeral 28 denotes a leaf spring which is expanded against the plane plate 26 while imparting rotational braking force to a knob 21.

Figure 2:
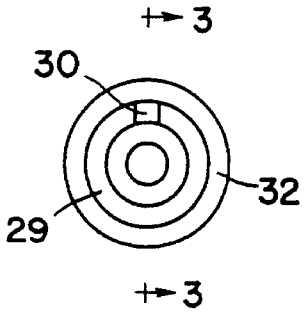
FIG. 2 is a front view of a second bearing sleeve.
Figure 3:
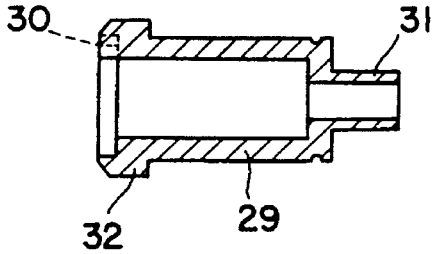
FIG. 3 is a vertical sectional view of the second bearing sleeve taken along line 3—3 in FIG. 2.

Reference numeral 29 denotes a second bearing sleeve which is fixed to the rear end of the first bearing sleeve 25 with the aid of a key 30 and fitted onto the small diameter portion 24 of the dial shaft 22. As shown in FIG. 2 and FIG. 3, the rear end part of the second bearing sleeve 29 is machined to provide a small diameter sleeve portion 31 corresponding to the small diameter shaft portion 24 of the dial shaft 22. The fore end part of the second bearing sleeve 29 is expanded to serve as a spring retainer.

Reference numeral 33 denotes a driving plate which is fitted onto the small diameter shaft portion 24 so as to rotate together with the dial shaft 22. The driving plate 33 is molded of a hard synthetic resin in a silk hat-like contour. The driving plate 33 includes a flange portion 34 having an outer periphery in which an unlocking cutout 35 is formed. In addition, a driving gear 36 is generated along an inner peripheral surface of a barrel portion of the driving plate 33. Reference numeral 37 denotes a ring which prevents the driving plate 33 from being undesirably disengaged from the dial shaft 22.

Figure 4:
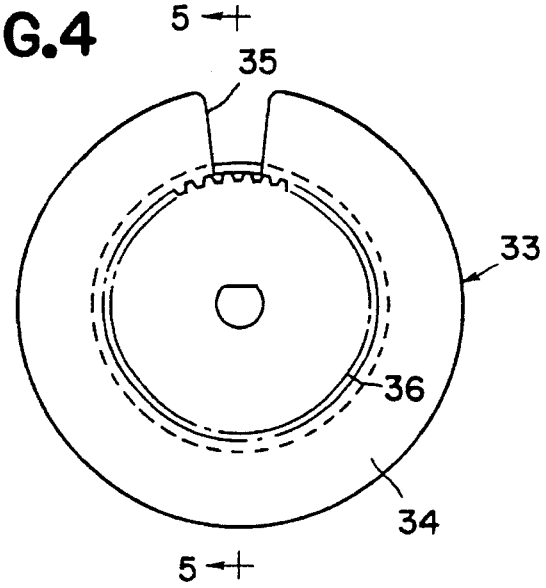
FIG. 4 is a front view of a driving plate.
Figure 5:
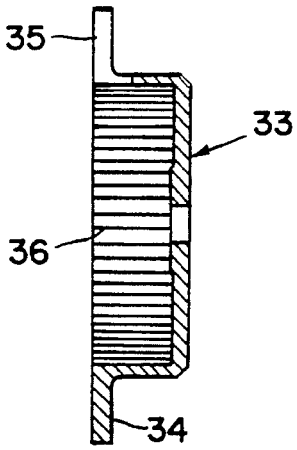
FIG. 5 is a sectional view of the driving plate taken across line 5—5 in FIG. 4.
Figure 6:
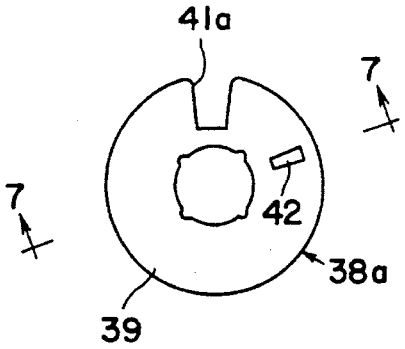
FIG. 6 is a front view of a rear lock plate.
Figure 7:
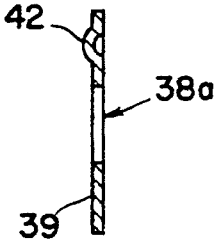
FIG. 7 is a sectional view of the rear lock plate taken along line 7—7 in FIG. 6.
Figure 8:
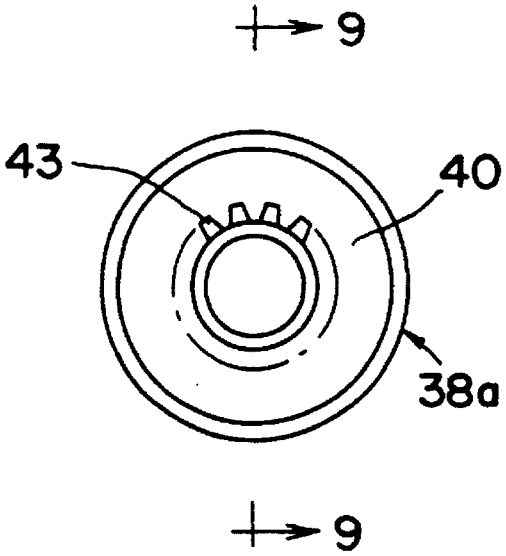
FIG. 8 is a front view of a hub portion.
Figure 9:
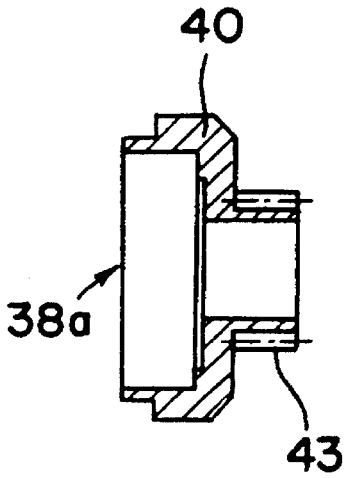
FIG. 9 is a sectional view of the hub portion taken along line 9—9 in FIG. 8.
Figure 10:
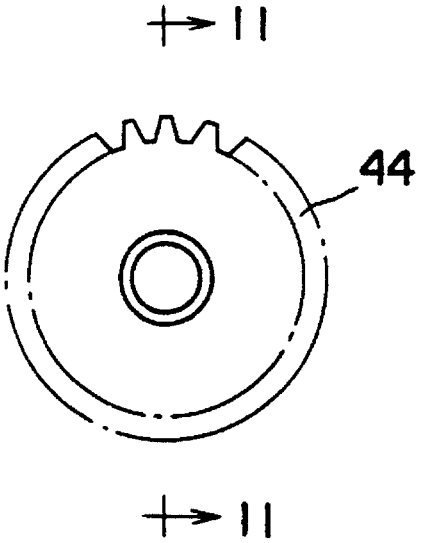
FIG. 10 is a front view of an idle gear.
Figure 11:
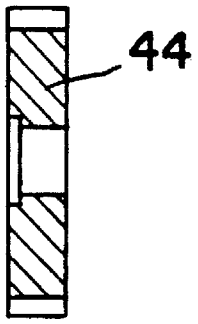
FIG. 11 is a sectional view of the idle gear taken along line 11—11 in FIG. 10.

To assure that the driving plate 33 is firmly connected to the dial shaft 22, a non-circular hole is formed at the central part of the driving plate 33 as shown in FIG. 4. The rear end of the dial shaft 22 having the same non-circular sectional shape is fitted into the non-circular hole of the driving plate 33.

Reference numeral **38*a* denotes a rear lock plate which faces the driving plate 33. As shown in FIG. 6 to FIG. 9, the rear lock plate 38*a* is provided as an assembly comprising a flange portion 39 having the same diameter as that of flange portion 34 of the driving plate 33 and a hub portion 40 molded of a hard synthetic resin coaxially fitted to the driving plate 33. The hub portion 40 is rotatably supported on the small diameter sleeve portion 31 of the second bearing sleeve 29**.

Reference numeral **41*a* denotes an unlocking cutout formed in the outer peripheral part of the flange portion of the lock plate 38*a*, and reference numeral 42 denotes an engagement projection raised from the plate surface of the flange portion 39. The engagement projection 42** is engaged with a rear engagement projection of a first intermediate lock plate which will be described later.

As shown in FIG. 1, the hub portion 40 of the lock plate **38*a* is dimensioned to have a diameter smaller than that of the driving plate 33, and a follower gear 43 is generated along the outer peripheral surface of the hub portion 40**.

The follower gear 43 associated with the lock plate **38*a* is accommodated in the driving plate 33, and an idle gear 44 is disposed between the driving gear 36 and the follower gear 43 so that the gears 36 and 43 are rotated in the opposite directions. A gear ratio of the driving gear 36 and the follower gear 43 is set to 3:1. Thus, when the driving plate 33 is rotated by the dial knob 21 by an angle of 360 degrees (one revolution), the lock plate 38*a*** is rotated three times.

Reference numeral 45 denotes a stationary plate which is located between the hub portion 40 of the lock plate **38*a* and the driving plate 33, and reference numeral 46 denotes an idle gear shaft which is axially projected from the stationary plate 45 so as to rotatably support the idle gear 44**.

Reference numerals **38*b* and 38*c* denote a first intermediate lock plate and a second intermediate lock plate which are successively arranged forward to the lock plate 38*a*, and reference numeral 38*d* denotes a fore lock plate which is arranged forwardly of the second intermediate lock plate 38*c*. Each of three lock plates, i.e., the lock plates 38*b*, 38*c* and 38*d* is made of a circular metallic plate and has the same diameter as that of the flange portion 39 of the lock plate 38*a*. Unlocking cutouts 41*b*, 41*c* and 41*d* are formed in the outer peripheries of lock plate 38*b*, 38*c* and 38*d* and such three lock plates are rotatably supported on the second bearing sleeve 29**.

Figure 12:
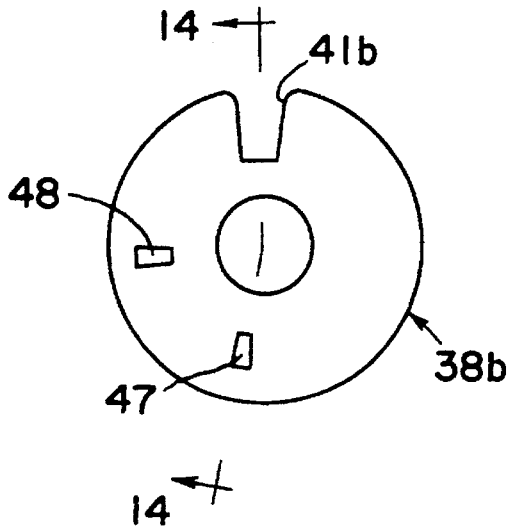
FIG. 12 is a front view of a first intermediate lock plate.
Figure 13:
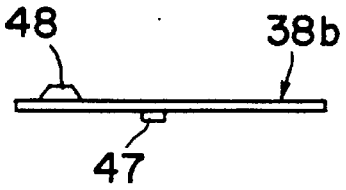
FIG. 13 is a side view of the first intermediate lock plate.
Figure 14:
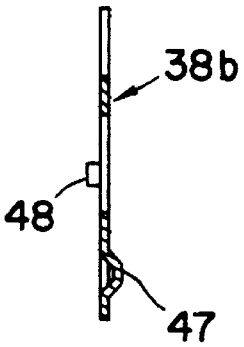
FIG. 14 is a sectional view of the first intermediate lock plate taken along line 14—14 in FIG. 12.

On receipt of the rotational force from the lock plate **38*a*, the remaining three lock plates are followably rotated from the rear side. Specifically, as shown in FIG. 12 to FIG. 14, a fore engagement projection 47 and a rear engagement projection 48 are projected from the opposite side surfaces of the first intermediate lock plate 38*b* so that the rear engagement projection 48 is engaged with the fore engagement projection of the lock plate 38*a***.

Figure 15:
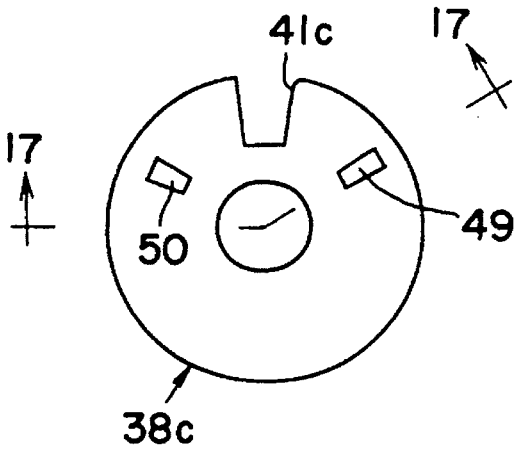
FIG. 15 is a front view of a second intermediate lock plate.
Figure 16:
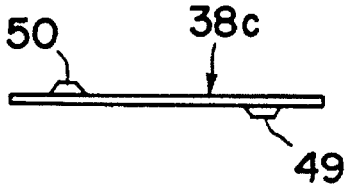
FIG. 16 is a side view of the second intermediate lock plate.
Figure 17:
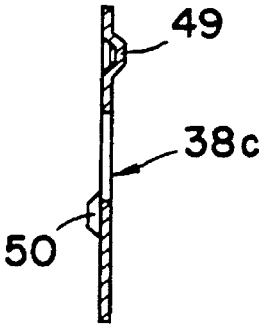
FIG. 17 is a sectional view of the second intermediate lock plate taken along line 17—17 in FIG. 15.

As shown in FIG. 15 to FIG. 17, a fore engagement projection 49 and a rear engagement projection 50 are projected from the opposite side surfaces of the second intermediate lock plate 38*c* so that the rear engagement projection 50 is engaged with the fore engagement projection 47 of the first intermediate lock plate 38*b*.

Figure 18:
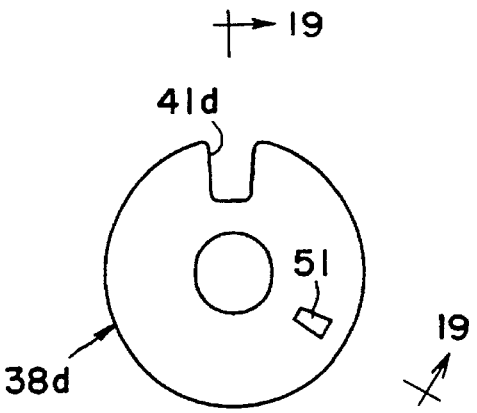
FIG. 18 is a front view of a fore lock plate.
Figure 19:
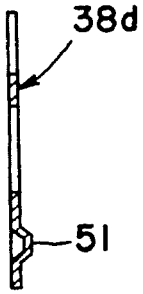
FIG. 19 is a sectional view of the fore lock plate taken along line 19—19 in FIG. 18.

Reference numeral 51 denotes a rear engagement projection which is projected from the side surface of the lock plate 38*d* as shown in FIGS. 18 and 19. The rear engagement projection 51 is engaged with the fore engagement projection 49 of the second intermediate lock plate 38*c*. With such construction, when the dial knob 21 is rotated by an angle of 360 degrees (one revolution), all the lock plates are rotated based on the gear ratio of the driving gear 36 of the driving plate 33 and the follower gear 43 of the lock plate 38*a*.

In this case, rotational angular positions of the engagement projections 42, 47, 48, 49, 80 and 51 projected from the four lock plates 38*a* to 38*d* as measured from the respective unlocking recesses 41*a* to 41*d* are adequately determined corresponding to an identification code number of the combination lock. Thus, it of course is obvious that memory numerals available for unlocking are preliminarily determined corresponding to the rotational angular positions. When the positions where the engagement projections 42, 47 to 51 are projected vary, the memory numerals of the combination lock vary correspondingly. The combination lock has a different actuation sequence than the conventional lock, in spite of being of the same type.

Reference numeral 52 denotes three spacers which are interposed between adjacent lock plates among the lock plates 38*a* to 38*d*. The spacers 52 are unrotatably fitted on the second bearing sleeve 29. Reference numeral 53 denotes a compression spring which is disposed between the spring retainer 32 of the second bearing sleeve 29 and the lock plate 38*d* so as to impart an adequate intensity of thrusting force to all the lock plates 38*a* to 38*d*.

Figure 20:
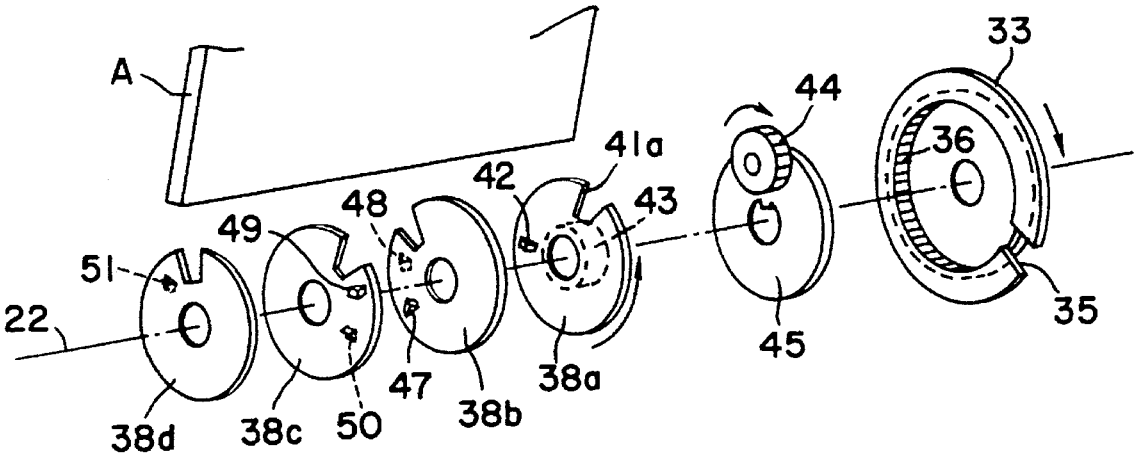
FIG. 20 is a perspective view which shows a step of unlocking the combination lock of the present invention, wherein main components are disassembled and some are not illustrated, and wherein the rear lock plate is engaged with the first intermediate lock plate.

The combination lock constructed in the above-described manner is unlocked by way of the following steps. FIG. 20 shows by way of a disassembled view the locked state of the combination lock. When the locked combination lock is unlocked, first the dial knob 21 is rotated from a predetermined reference numeral in the clockwise direction by an angle of ⅓ revolution so that the lock plate 38*a* is rotated by an angle of 360 degrees (one revolution) via gear meshing of the driving gear 36 with the follower gear 43. Thereby, the fore engagement projection 42 on the lock plate 38 is brought in engagement with the rear engagement projection 48 on the first intermediate lock plate 38*b*.

Figure 21:
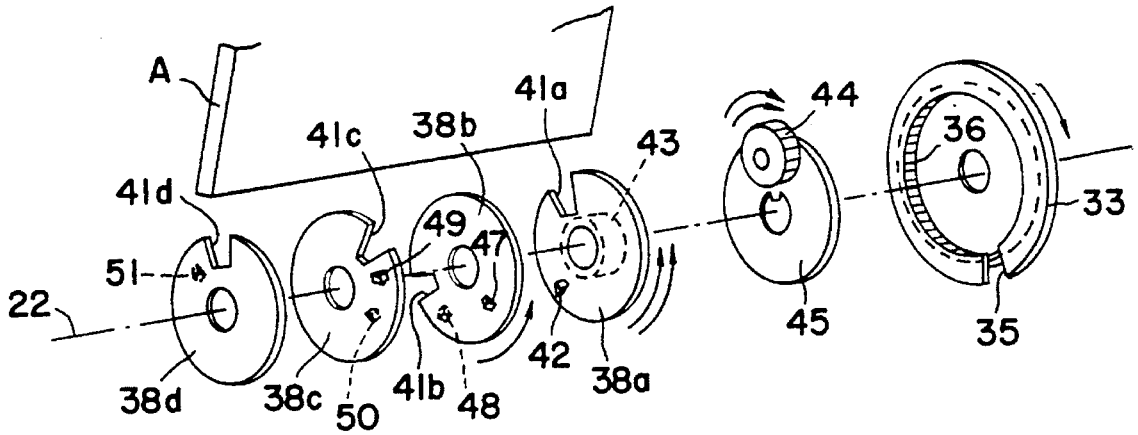
FIG. 21 is a perspective view which shows a step of unlocking the combination lock of the present invention, wherein main components are disassembled and some are not illustrated, and wherein the first intermediate lock plate rotating integrally with the rear lock plate is engaged with the second intermediate lock plate.

Next, as shown in FIG. 21, the dial knob 21 is rotated in the same direction by an angle of ⅓ revolution so that the lock plate 38*a* and the first intermediate lock plate 38*b* are rotated together by an angle of 360 degrees. Thus, the fore engagement projection 47 on the first intermediate lock plate 38*b* is engaged with the rear engagement projection 50 on the second intermediate lock plate 38*c*.

Figure 22:
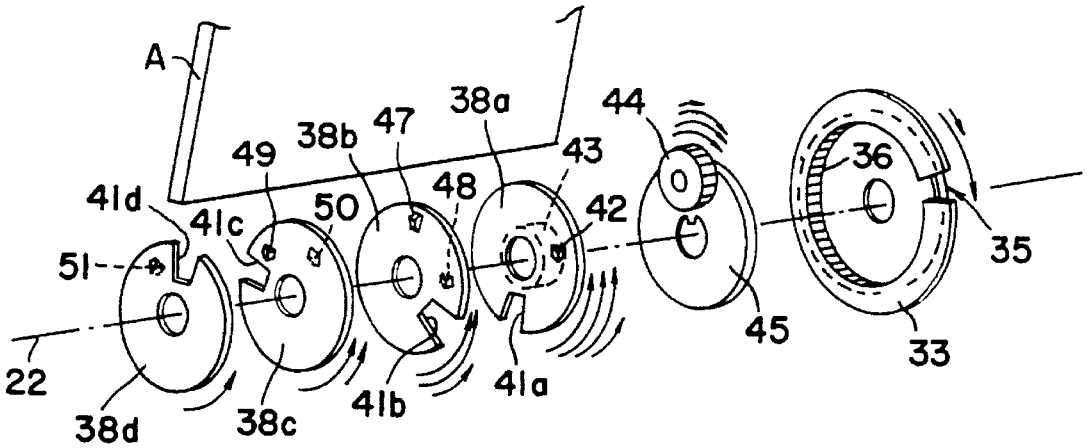
FIG. 22 is a perspective view which shows a step of unlocking the combination lock of the present invention, wherein main components are disassembled and some are not illustrated, and wherein the second intermediate lock plate rotating integrally with the rear lock plate and the first intermediate lock plate is engaged with the fore lock plate, an unlocking cutout of which is located at a predetermined angular position.

Thereafter, as shown in FIG. 22, the dial knob 21 is further rotated in the same direction by an angle of ⅓ revolution so that the lock plate 38*a* and the first and second intermediate lock plates 38*b* and 38*c* are rotated together by an angle of 360 degrees (one revolution) so as to allow fore engagement projection 49 on the second intermediate lock plate 38*c* to be engaged with rear engagement projection 51 on the rear lock plate 38*d*. Then, the second intermediate lock plate 38*c* is further rotated by a predetermined angle less than 360 degrees to reach a preliminarily determined memory numeral. At this time, the unlocking recess 41*d* in the rear lock plate 38*d* is oriented in the upward direction.

Figure 23:
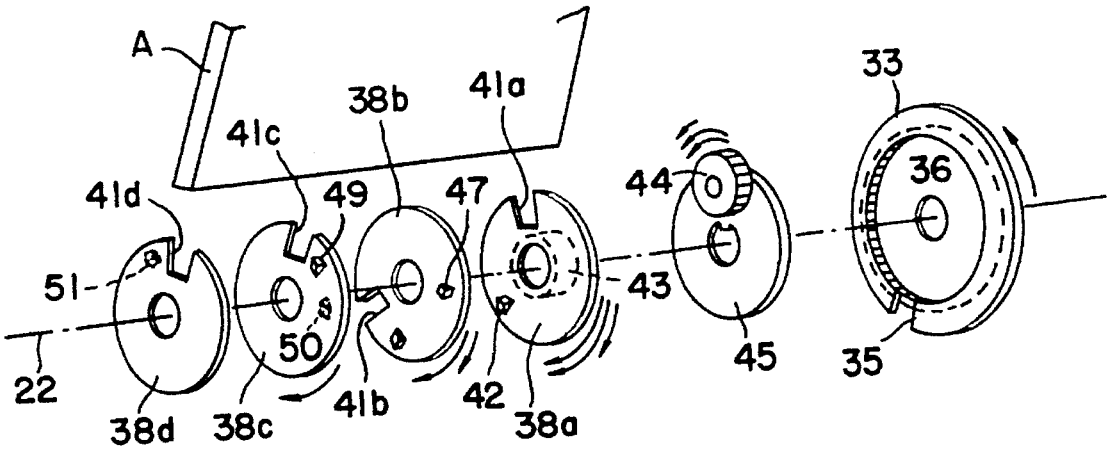
FIG. 23 is a perspective view which shows a step of unlocking the combination lock of the present invention, wherein main components are disassembled and some are not illustrated, and wherein a dial knob is turned in a direction such that an unlocking cutout of the second intermediate lock plate is located at a predetermined position and the unlocking cutout of the fore lock plate is held at the predetermined position.

Next, as shown in FIG. 23, when fore lock plate 38*a* is rotated twice and the first intermediate lock plate 38 is turned by one revolution by rotating the dial knob 21 in the counterclockwise direction, the fore engagement projection 47 on the first intermediate lock plate 38*b* is engaged with the rear engagement projection 50 on the second intermediate lock plate 38*c*. While the foregoing state is maintained, the first and second intermediate lock plates 38*b* and 38*c* are further rotated by an angle less than 360 degrees until a preliminarily determined memory numeral is reached. At this time, the unlocking recess 41*c* in the second intermediate lock plate 38*c* is located in alignment with the unlocking recess 41*d* on the lock plate 38*d* which has been kept immovable.

At this time, since the second intermediate lock plate 38*c* is held integral with the dial shaft 22, it is rotated together with the dial knob 21 while the lock plate 38*d* is left at the preset angular position.

Figure 24:
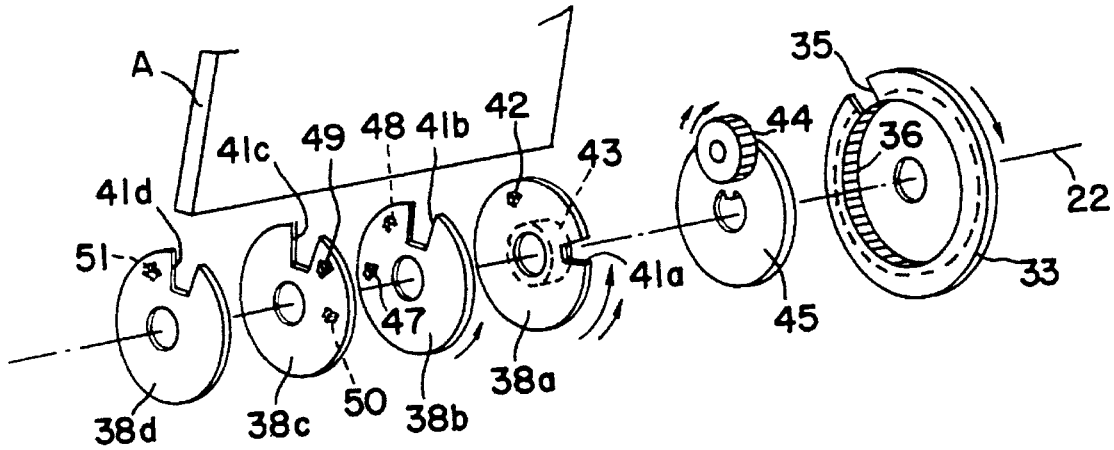
FIG. 24 is a perspective view similar to FIG. 23 which shows that the dial knob is turned in a direction opposite to that in FIG. 23 and an unlocking cutout is located at a predetermined angular position.

Next, when the lock plate 38*a* is rotated by one revolution by turning the dial knob 21 in the clockwise direction as shown in FIG. 24, the fore engagement projection 42 on the lock plate 38*a* is engaged with the rear engagement projection 48 on the first intermediate lock plate 38*b*. While the foregoing state is maintained, the lock plate 38*a* is further rotated by a predetermined angle less than 360 degrees until a preliminarily determined memory numeral is reached so that the unlocking recess 41*b* inn the first intermediate lock plate 38*b* is located in alignment with those on the lock plate 38*d* and the second intermediate lock plate 38*c* which have been kept immovable. At this time, the unlocking recesses 41*b*, 41*c* and 41*d* are oriented in the upward direction.

Figure 25:
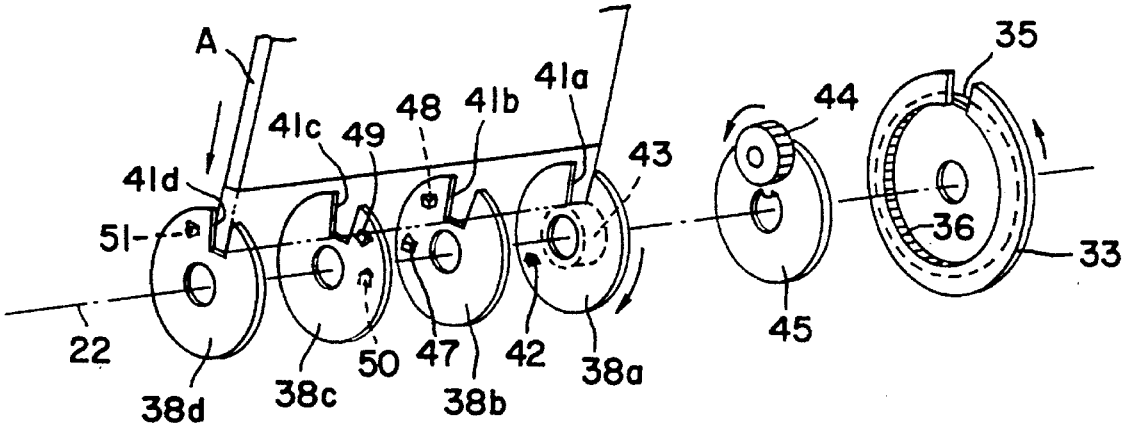
FIG. 25 is a perspective view similar to FIG. 24 which shows that unlocking cutouts of all lock plates are located at predetermined angular positions.
Figure 26:
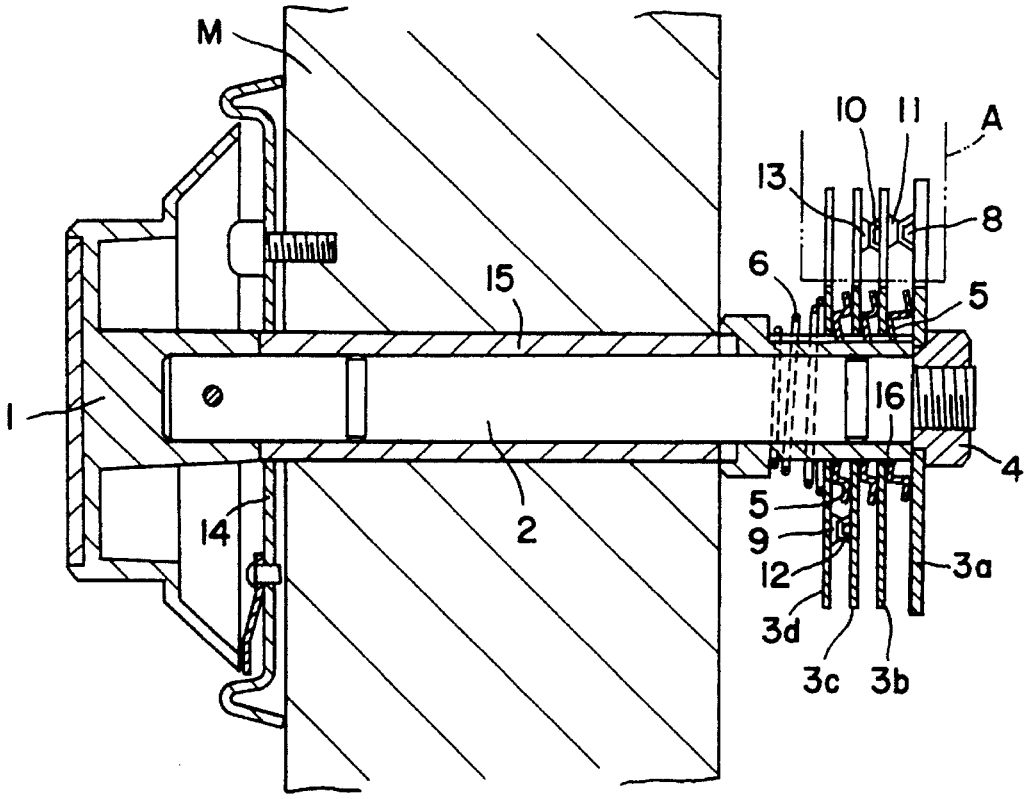
FIG. 26 is a vertical sectional view which shows by way of example the structure of a conventional combination lock.
Figure 27:
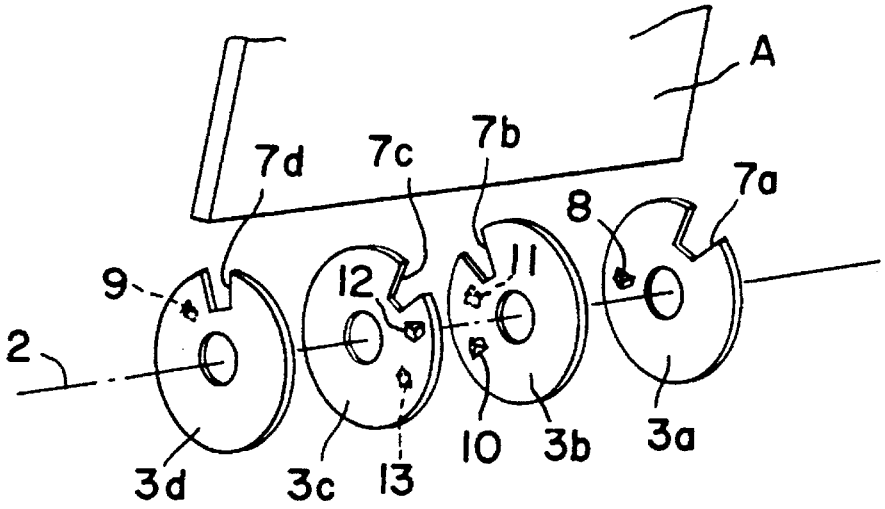
FIG. 27 is a perspective view which shows a step of unlocking the conventional combination lock, wherein main components are disassembled and some are not illustrated, and wherein the shown state corresponds to that shown in FIG. 20.
Figure 28:
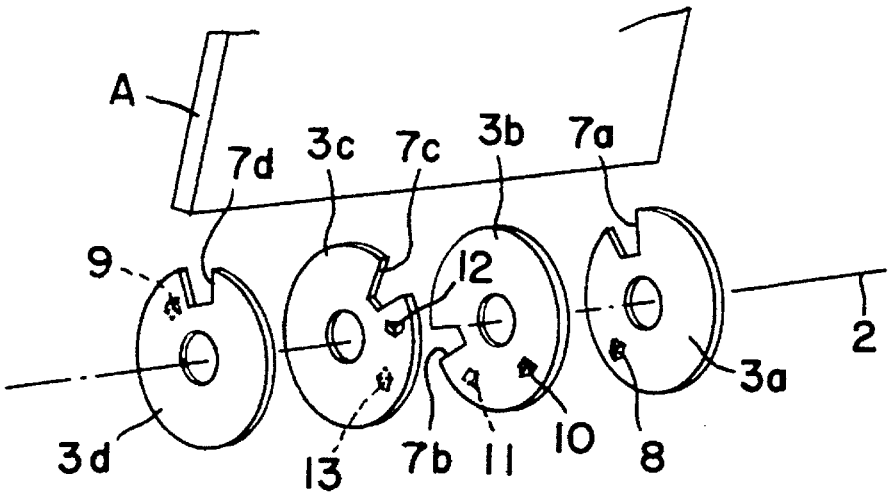
FIG. 28 is a perspective view which shows a step of unlocking the conventional combination lock, wherein main components are disassembled and some are not illustrated, and wherein the shown state corresponds to that shown in FIG. 21.
Figure 29:
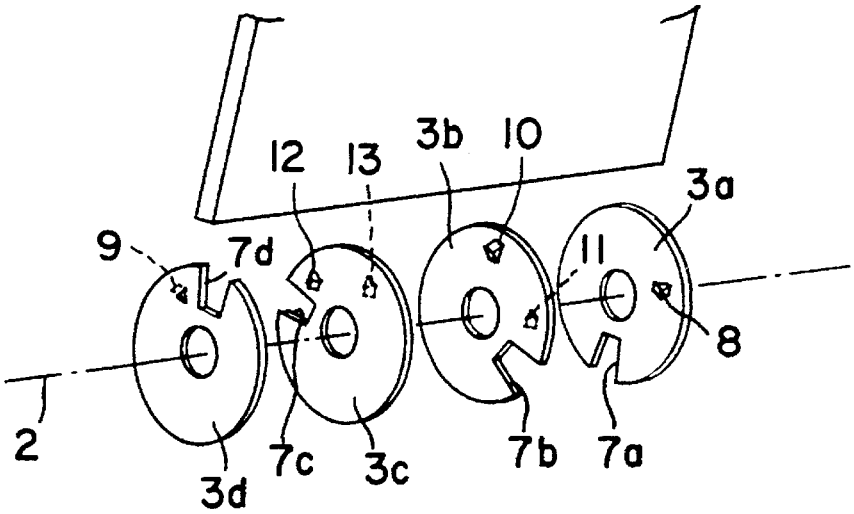
FIG. 29 is a perspective view which shows a step of unlocking the conventional combination lock, wherein main components are disassembled and some are not illustrated, and wherein the shown state corresponds to that shown in FIG. 22.
Figure 30:
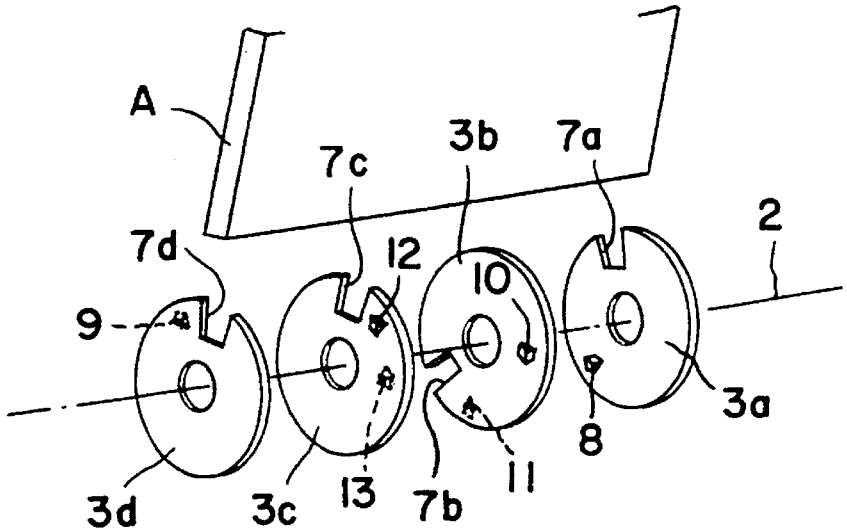
FIG. 30 is a perspective view which shows a step of unlocking the conventional combination lock, wherein main components are disassembled and some are not illustrated, and wherein the shown state corresponds to that shown in FIG. 23.
Figure 31:
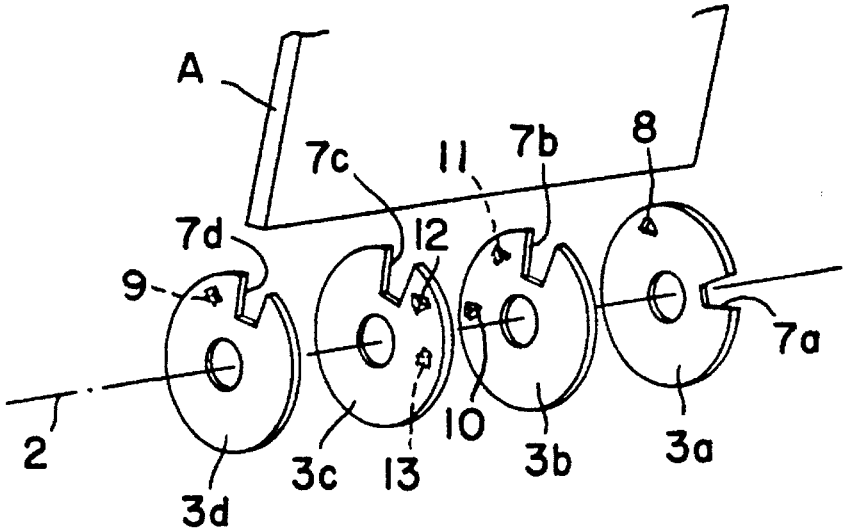
FIG. 31 is a perspective view which shows a step of unlocking the conventional combination lock, wherein main components are disassembled and some are not illustrated, and wherein the shown state corresponds to that shown in FIG. 24.
Figure 32:
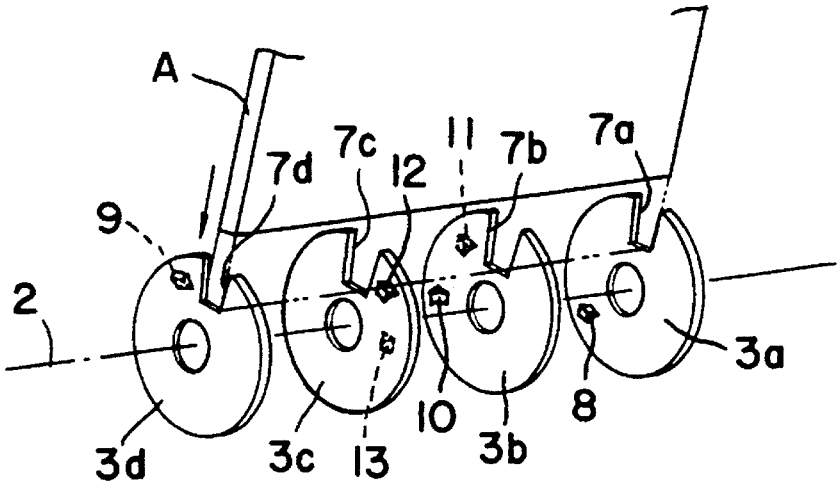
FIG. 32 is a perspective view which shows a step of unlocking the conventional combination lock, wherein main components are disassembled and some are not illustrated, and wherein the shown state corresponds to that shown in FIG. 25.

Again, when the dial knob 21 is rotated in the counterclockwise direction by a predetermined angle less than 360 degrees until a preliminarily determined memory value is reached so that the unlocking cutout 41*a* on the lock plate 38*a* is located in alignment with those on the lock plate 38*d* and the first and second intermediate lock plates 38*b* and 38*c*, the combination lock is brought to an unlocked state that the lock pawl A can be received in the engagement recesses 41*a* to 41*d* formed in all the lock plates 38*a* to 38*d* as shown in FIG. 25.

In other words, four lock plates 38*a* to 38*d* are located in parallel to each other in such a manner that one lock plate can followably be rotated by adjacent one. Since the driving gear 36 associated with the driving plate 33 rotated together with the dial knob 21 meshes with the follower gear 43 associated with the lock plate 38*a*, it is sufficient that the dial knob 21 is turned by one revolution (360 degrees). Thus, provided that a user memorized predetermined memory numerals, an unlocking operation can be achieved quickly at a high efficiency.

The shown embodiment has been described above with respect to the combination lock including four lock plates 38*a* to 38*d*. However, since it is sufficient that a single intermediate lock plate is used, in the case that a combination lock is produced using three lock plates inclusive of the foregoing intermediate lock plate, a gear ratio of the driving gear 36 to the follower gear 43 is set to 2:1. In addition, in the case that five lock plates in total are employed to build a combination lock, it is acceptable that the gear ratio is set to 4:1. Thus, the desired object of the present invention can be accomplished by suitably modifying the above discussed features.

It is obvious that when at least one of the unlocking recess 41*a* to 41*d* formed in the lock plates 38*a* to 38*d* is dislocated from the remaining ones, the combination lock is brought to a locked state.

As described above, the combination lock of the present invention is composed of the dial shaft 2 rotationally actuated by the dial knob 21, the rear lock plate 38*a* rotatably supported on the dial shaft 22 at a position in the vicinity of the rearmost end of the dial shaft 22, at least one of the intermediate lock plates 38*b* and 38*c*, the fore lock plate 38*d*, and the driving plate 33 integrally rotatably fitted to the rear end of the dial shaft 22 and located adjacent to the rear lock plate 38*a*.

The unlocking recesses 35, 41*a*, 41*b*, 41*c* and 41*d* are formed along the outer peripheries of the lock plates 38*a* to 38*d* and the driving plate 33 so as to receive the lock pawl A. The driving gear 36 having a large diameter is formed in the driving plate 33, the follower gear 43 having a small diameter is disposed at the lock plate 38*a* located adjacent to the driving plate 33, and the idle gear 44 is interposed between the driving gear 36 and the follower gear 43 so as to allow the gears 36 and 43 to be rotated in the opposite directions. The gear ratio is determined such that all the lock plates 38*a* to 38*d* are followably rotated by one revolution of the dial knob 21. With such construction, the technical problems described above with reference to FIG. 26 to FIG. 32 have been solved with the result that a combination lock which can very simply be unlocked has been provided.

Specifically, with construction of the invention, the dial knob 21 is rotated from a preliminarily determined reference numeral, e.g., by an angle of 360 degrees (one revolution) in the clockwise direction to locate the unlocking recess 41*d* in the fore lock plate 38*d*, next the dial knob 21 is rotated by a predetermined angle less than 360 degrees in the counterclockwise direction to reach a preliminarily determined memory numeral so that the unlocking recesses 41*b* to 41*c* on the intermediate lock plates 38*b* and 38*c* are located in alignment with recess 41*d* in the lock plate 38*d*, and the dial knob 21 is rotated by a predetermined angle less than 360 degrees in the clockwise direction to reach a preliminarily determined memory numeral so that the unlocking recess 41*a* in the rear lock plate 38*a* is located in alignment with recesses 41*b*–41*d* in the lock plate 38*d* and the intermediate lock plates 38*b* and 38*c*, whereby the combination lock can be unlocked.

In other words, since all the lock plates 38*a* to 38*d* are successively followably rotated by the turning movement of the dial knob 21 by one revolution, provided that a user memorizes memory numerals corresponding to the lock plates 38*a* to 38*d* so as to allow the lock plates 38*a* to 38*d* to be alternately rotated by an angle less than 360 degrees in the normal/opposite direction, the combination lock can quickly be unlocked.

With the combination lock of the present invention, since each of the lock plates 38*a* to 38*d* is rotated by a rotational angle three times of that of the dial shaft 22, there is increased a probability that the unlocking recesses 41*a* to 41*d* are located in alignment with each other. Since the unlocking recess 35 is formed on the driving plate 33, an unlocked state is established when all unlocking recess 35 and 41*a* to 41*d* are located in alignment with each other. Consequently, there does not arise a malfunction that safety of a lock is reduced.

Especially, with the construction of the invention, the driving plate 33 is made in a silk hat-like contour adapted to surround the hub portion 40 of the rear lock plate 38*a*. Since the driving gear 36 having a large diameter and generated around the inner peripheral surface of the barrel portion of the driving plate 33 and the follower gear 43 having a small diameter and generated around the outer peripheral surface of the hub portion 40 mesh with each other via a single idle gear 44 at the aforementioned gear ratio, the combination lock can compactly be incorporated in a commercial safe, a holding chamber for various items or the like without any necessity of modifying the safe, the holding chamber or the like.

While the present invention has been described above with respect to a single preferred embodiment, it should be understood that the present invention should not be limited only to this embodiment, but that various changes or modifications may be made without departure from the scope of the present invention as defined by the appended claim.

What is claimed is:

1. A combination lock comprising:

a dial shaft adapted to be rotated with a user's hand, a fore lock plate, at least one intermediate lock plate and a rear lock plate arranged in parallel with each other so as to allow them to be followably rotated via a plurality of engagement projections projected from opposite side surfaces of said lock plates, and a driving plate integrally fitted to a rear end of said dial shaft, a plurality of unlocking cutouts formed in outer peripheries of said driving plate and said lock plates so as to allow a lock pawl to be received in said unlocking cutouts when the latter are located in alignment with each other, and a driving gear having a large diameter formed in said driving plate, and a follower gear having a small diameter formed on said rear lock plate located adjacent to said driving plate, said driving gear and said follower gear meshing with each other at a gear ratio via an idle gear so as to allow said driving and follower gears to be rotated in opposite directions, said gear ratio being determined such that all said lock plates are followably rotated as said dial shaft is rotated with a user's hand.

2. The combination lock as claimed in claim 1, wherein the number of lock plates is four, and said gear ratio of said driving gear to said follower gear is set to 3:1.

3. The combination lock as claimed in claim 1, wherein said follower gear is formed around an outer periphery of a hub portion of said rear lock plate, the whole driving plate is formed in a silk hat-like contour so as to allow said hub portion to be received in said silk hat-like contour, said driving gear is formed around an inner periphery of said silk hat-like contour, and said idle gear is interposed between said driving gear and said follower gear facing to each other.

* * * * *